US012644632B2

(12) United States Patent
Kjær et al.

(10) Patent No.: US 12,644,632 B2
(45) Date of Patent: Jun. 2, 2026

(54) DEVICE AND METHOD FOR RECOVERY OF REFRIGERANT

(71) Applicant: Agramkow Fluid Systems A/S, Sønderborg (DK)

(72) Inventors: Bjørn Halborg Kjær, Vojens (DK); Morten Klietsch, Sønderborg (DK); Bent Jørn Lorenzen, Sønderborg (DK)

(73) Assignee: Agramkow Fluid Systems A/S, Sønderborg (DK)

( * ) Notice: Subject to any disclaimer, the term of this patent is extended or adjusted under 35 U.S.C. 154(b) by 93 days.

(21) Appl. No.: 18/411,426

(22) Filed: Jan. 12, 2024

(65) Prior Publication Data

US 2024/0240844 A1 Jul. 18, 2024

(30) Foreign Application Priority Data

Jan. 13, 2023 (DK) ..... PA202370014

(51) Int. Cl.
*F25B 45/00* (2006.01)

(52) U.S. Cl.
CPC ..... *F25B 45/00* (2013.01); *F25B 2345/002* (2013.01)

(58) Field of Classification Search
CPC ..... F25B 2345/002; F25B 45/00
See application file for complete search history.

(56) References Cited

U.S. PATENT DOCUMENTS 4,204,559 A 5/1980 Wagner
4,537,214 A 8/1985 Cowan
5,275,013 A 1/1994 Price et al.
5,293,771 A 3/1994 Ridenour
5,373,866 A 12/1994 Whalen
(Continued)

FOREIGN PATENT DOCUMENTS

CN 203479472 U 3/2014
CN 207717291 U 8/2018
(Continued)

OTHER PUBLICATIONS

Office Action issued in DK Application No. PA202370014, dated Aug. 9, 2023.
(Continued)

*Primary Examiner* — Ana M Vazquez
(74) *Attorney, Agent, or Firm* — Knobbe, Martens, Olson & Bear, LLP

(57) ABSTRACT

A device for recovery of refrigerant from a sealed heat transfer system includes a refrigerant conduit formed in the device for guiding a flow of refrigerant from the heat transfer system to a refrigerant outlet of the device, a refrigerant inlet to the refrigerant conduit. The refrigerant inlet can be provided in a surface of the device. The device can include a tool for providing an opening between an opening area of a part of the heat transfer system and the refrigerant inlet, a driver to drive a movement of the tool in order to provide the opening in the opening area. The device further includes a first gas conduit formed in the device for guiding a flow of gas between a first internal gas opening being provided in a surface of the device and a first external gas opening of the device.

30 Claims, 4 Drawing Sheets

(56) References Cited

U.S. PATENT DOCUMENTS

| | | | | |
|---|---|---|---|---|
| 6,655,407 | B1 * | 12/2003 | Dudley | F16L 41/065 62/294 |
| 6,748,968 | B1 * | 6/2004 | Parsons | F15B 13/0857 137/15.13 |
| 12,085,479 | B2 | 9/2024 | Thyssen et al. | |
| 2004/0173006 | A1 | 9/2004 | McCoy et al. | |
| 2010/0253376 | A1 | 10/2010 | Bley et al. | |
| 2011/0283769 | A1 | 11/2011 | Bohn et al. | |
| 2012/0260722 | A1 | 10/2012 | McGregor | |
| 2022/0003627 | A1 | 1/2022 | Thyssen et al. | |
| 2024/0175778 | A1 | 5/2024 | Andreasen et al. | |
| 2025/0130131 | A1 | 4/2025 | Thyssen et al. | |

FOREIGN PATENT DOCUMENTS

| | | | |
|---|---|---|---|
| CN | 109724750 | A | 5/2019 |
| CN | 110005898 | A | 7/2019 |
| CN | 110285930 | A | 9/2019 |
| CN | 110631780 | A | 12/2019 |
| CN | 213900268 | U | 8/2021 |
| DE | 29601629 | U1 | 3/1996 |
| DE | 102013021313 | A1 | 6/2015 |
| EP | 1014015 | A1 | 6/2000 |
| EP | 2485030 | A1 | 8/2012 |
| JP | 2003035622 | A | 2/2003 |
| JP | 2006-153286 | | 6/2006 |
| JP | 2006153286 | A * | 6/2006 |
| KR | 102043731 | B1 | 11/2019 |
| WO | WO 99/10721 | A1 | 3/1999 |
| WO | WO 2012/120179 | A1 | 9/2012 |
| WO | WO 2012/142402 | A1 | 10/2012 |
| WO | WO 2023/041791 | A1 | 3/2023 |
| WO | WO 2023/057107 | A1 | 4/2023 |
| WO | WO 2023/131436 | A1 | 7/2023 |
| WO | WO 2023/131438 | A1 | 7/2023 |
| WO | WO2023/169723 | A1 | 9/2023 |

OTHER PUBLICATIONS

Extended European Search Report issued in EP Application No. 24151610.3, dated Jun. 5, 2024.

International Search Report for International Patent Application No. PCT/EP2020/084929, dated Jun. 21, 2021 in 5 pages.

* cited by examiner

DEVICE AND METHOD FOR RECOVERY OF REFRIGERANT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

FIELD

The present technology relates to a device for recovery of refrigerant from a sealed heat transfer system as well as a method of recovering refrigerant from a sealed heat transfer system by use of a device.

BACKGROUND

Recovery of refrigerant from sealed heat transfer systems, such as industrial scale refrigeration systems, refrigeration systems for refrigerated intermodal shipping containers, the so-called reefer containers, as well as household freezers, air conditioning systems, heat pumps and refrigerators is an important part of the manufacturing process of such systems as well as for repair or dismantling of such systems.

It is generally a concern to effectively prevent the refrigerant to leak into the environment during recovery from the heat transfer system for various reasons as refrigerants may be harmful to the general environment, may be flammable, such as propane (R290) and isobutane (R600a) and/or toxic or otherwise hazardous, such as ammonia ($NH_3$, R717) or $CO_2$ (R744).

Traditionally, this is obtained by applying suction to the instrument used for recovering the refrigerant and by providing efficient ventilation of the area where the recovery is performed.

It is an object of the present technology to provide improvements to reduce the risk of hazard due to possible leaks of refrigerants during recovery of refrigerant from sealed heat transfer systems.

SUMMARY

A first aspect of the disclosed technology comprises a device for recovery of refrigerant from a sealed heat transfer system. The device comprises a refrigerant conduit formed in the device for guiding a flow of refrigerant from the heat transfer system to a refrigerant outlet of the device. The device further comprises a refrigerant inlet to the refrigerant conduit, the refrigerant inlet being provided in a surface of the device. The device further comprises a tool for providing an opening between an opening area of a part of the heat transfer system and the refrigerant inlet, and a driver to drive a movement of the tool in order to provide the opening in the opening area. The device further comprises a first gas conduit formed in the device for guiding a flow of gas between a first internal gas opening being provided in the surface of the device and a first external gas opening of the device. Moreover, the device comprises an outer, resilient gasket arranged to provide a sealed-off space enclosing a surface of the device, a surface of the part of the heat transfer system and the first internal gas opening when the device is mounted to the part of the heat transfer system.

The opening at the opening area of the part of the heat transfer system is sealed with an outer gasket, enclosing the opening into the part of the heat transfer system. Thus, with the device is obtained a safer instrument for recovery of a refrigerant from a part of a heat transfer system, such as a refrigerator or an air conditioning system. Furthermore, the first internal gas opening provided in the device into the sealed-off space makes it possible to prevent that a potential leak in the resilient gasket will result in refrigerant escaping into the environment, as the sealed-off space may be provided with a safe gas at a higher pressure than the pressure of the refrigerant. The sealed-off space may be pressurized with nitrogen gas being substantially oxygen-free. The sealed-off space may also be provided with suction and a lower gas pressure than the pressure of the refrigerant, so that a possible leak of refrigerant into the sealed-off space could be removed by means of the suction.

The device may further comprise an inner, resilient gasket arranged to provide a first sealed-off space including the opening area and the refrigerant inlet when the device is mounted to the part of the heat transfer system. The outer, resilient gasket may be arranged to provide a second sealed-off space enclosing the first sealed-off space and including the inner, resilient gasket, a surface of the device, a surface of the part of the heat transfer system and the first Internal gas opening when the device (1, 101) is mounted to the part of the heat transfer system. The sealed-off space may therefore comprise a first sealed-off space and a second sealed-off space.

A second aspect of the disclosed technology comprises a method of recovering refrigerant from a sealed heat transfer system by use of a device according to the present disclosure. The method comprises the steps of:

- mounting the device to a dedicated part of the heat transfer system,
- providing an opening at an opening area of the part of the heat transfer system by means of the tool, and
- recovering of refrigerant from the sealed heat transfer system by allowing refrigerant to flow from the opening area through the sealed-off space, via the refrigerant inlet through the refrigerant conduit and the refrigerant outlet into a receiving arrangement for the refrigerant.

In some embodiments, recovering of refrigerant from the sealed heat transfer system is performed by allowing refrigerant to flow from the opening area through the first sealed-off space.

The disclosed aspects and preferred embodiments may be suitably combined with each other in any manner apparent to anyone of ordinary skill in the art, such that one or more features or embodiments disclosed in relation to one aspect may also be considered to be disclosed in relation to another aspect or embodiment of another aspect.

Further embodiments are defined in the dependent claims. It should be emphasized that the term "comprises/comprising" when used in this specification is taken to specify the presence of stated features, integers, steps, or components. It does not preclude the presence or addition of one or more other features, integers, steps, components, or groups thereof.

These and other features and advantages of the disclosed technology will in the following be further clarified with reference to the embodiments described hereinafter.

DETAILED DESCRIPTION

In some embodiments, the present disclosure relates to a device for recovery of refrigerant from a sealed heat transfer system, the device comprising a refrigerant conduct/conduit formed in the device for guiding a flow of refrigerant from the heat transfer system to a refrigerant outlet of the device, a refrigerant inlet to the refrigerant conduct, the refrigerant inlet being provided in a surface of the device, a tool for providing an opening between an opening area of a part of the heat transfer system and the refrigerant inlet, a driver to drive a movement of the tool in order to provide the opening in the opening area, an inner, resilient gasket arranged to provide a first sealed-off space including the opening area and the refrigerant inlet when the device is mounted to the part of the heat transfer system, wherein the device further comprises a first gas conduct/conduit formed in the device for guiding a flow of gas between a first internal gas opening being provided in a surface of the device and a first external gas opening of the device, and an outer, resilient gasket arranged to provide a second sealed-off space enclosing the first sealed-off space and including the inner, resilient gasket, a surface of the device, a surface of the part of the heat transfer system and the first internal gas opening when the device is mounted to the part of the heat transfer system.

As used herein, conduit or conduct may be a channel for conveying refrigerant or gas or fluid or any other substance. Conduct or conduit are used interchangeably.

As described herein, providing an opening between an opening area of a part of the heat transfer system and the refrigerant inlet may be perceived as forming an opening through a part of the heat transfer system, for example forming an opening on an opening area of the heat transfer system. The opening may be adjacent to the refrigerant inlet such that a flow between the refrigerant inlet of the device and the part of the heat transfer system may be allowed through the opening.

Thus, with the device in accordance with some embodiments is obtained a more safe instrument for recovery of a refrigerant from a part of a heat transfer system, such as a refrigerator or an air conditioning system, because the opening at the opening area of the part of the heat transfer system may be sealed with an inner gasket as well as an outer gasket, enclosing, when the device is in use, a second sealed-off space, which surrounds the first sealed-off space containing the opening into the part of the heat transfer system. Furthermore, the first internal gas opening provided in the device into the second sealed-off space makes it possible to prevent that a potential leak in the inner, resilient gasket will result in refrigerant escaping into the environment, as the second sealed-off space may be provided with a safe gas at a higher pressure than the pressure of the refrigerant, such as nitrogen gas being substantially oxygen-free, or the second sealed-off space may be provided with suction and a lower gas pressure than the pressure of the refrigerant, so that a possible leak of refrigerant into the second sealed-off space could be removed by means of the suction without spilling into the environment.

The device may further comprise clamping means for clamping the device to the part of the heat transfer system, wherein the clamping means are employed to clamp the device to the part of the heat transfer system to mount the device to the part of the heat transfer system. The clamping means may be manually operated by the user of the device or be operated by means of e.g. a pneumatic pressure or an electrical motor.

The tool is according to one embodiment of the present technology suitable for provide the opening in the opening area of the part of the heat transfer system by activating a valve of the heat transfer system, such as a quick coupler valve.

The tool and the driver may in some embodiments be arranged for providing the opening in the opening area of the part of the heat transfer system by forming an opening in an outer wall of the part of the heat transfer system. Such opening may be made by different methods, such as by drilling, shearing or punctuating the outer wall of the part of the heat transfer system. However, it may be preferred that the tool comprises a needle and that the driver be arranged for advancing the needle to pierce the outer wall of the part of the heat transfer system.

The device may further comprise a second gas conduct/conduit formed in the device between a second internal gas opening being provided in the device and a pressure sensor, wherein the sealed-off space further includes the second internal gas opening. In some embodiments, the second internal gas opening is included within the second sealed-off space.

Such pressure sensor may be employed to monitor the pressure in the second sealed-off space, e.g. in case it is pressurised by means of the first internal gas opening prior to the operation of recovering refrigerant, so as to perform a leak test to ensure that at least the outer gasket is functioning properly.

The device may further comprise a second gas conduct formed in the device for guiding a flow of gas between a second internal gas opening being provided in the device and a second external gas opening of the device, wherein the sealed-off space further includes the second internal gas opening, and wherein the sealed-off space forms a channel between the first internal gas opening and the second internal gas opening. In some embodiments, the sealed-off space may be the second sealed of space. In some embodiment, the second internal gas opening is included within the second sealed-off space and the second sealed-off space forms the channel between the first internal gas opening and the second internal gas opening. The second internal gas opening may be used in a leak test, where a gas pressure is provided in the second sealed-off space, or in the sealed-off space, and the gas is allowed to flow from the first internal gas opening and to the second internal gas opening, and the pressure of the gas that flows through the second gas conduct is measured to ensure that the pressure losses from the first internal gas opening is within an acceptable range.

The present technology relates in a second aspect to a method of recovering refrigerant from a sealed heat transfer system by use of a device as disclosed herein. In some embodiments, the method comprises the steps of: mounting the device to a dedicated part of the heat transfer system, providing an opening at an opening area of the part of the heat transfer system by means of the tool, and recovering of refrigerant from the sealed heat transfer system by allowing refrigerant to flow from the opening area through the first sealed-off space, via the refrigerant inlet through the refrigerant conduct and the refrigerant outlet into a receiving arrangement for the refrigerant.

The refrigerant may be mainly a flammable fluid, such as propane or isobutane and/or a toxic fluid, such as ammonia.

The method may further comprise the step of providing a gas pressure of a gas in the second sealed-off space by means of the first gas conduct, the gas pressure in the second sealed-off space exceeding the gas pressure of the refrigerant in the first sealed-off space, such as by at least 0.5 bar, preferably by at least 3 bar, while the refrigerant is recovered.

The gas may be preferably an oxygen-free gas, such as a nitrogen gas.

After the step of mounting the device and before the step of recovering of the refrigerant, the method may further comprise the step of providing a gas pressure in the second sealed-off space by means of the first gas conduct, the gas pressure in the second sealed-off space exceeding the gas pressure of the refrigerant in the heat transfer system, such as by at least 0.5 bar, preferably by at least 3 bar, so as to leak test the second sealed-off space.

The device may further comprise a second gas conduct and the step of providing a gas pressure in the second sealed-off space to leak test it may further comprise the step of allowing a flow of the gas from the first internal gas opening and to the second internal gas opening and measuring the pressure of the gas that flows through the second gas conduct.

The method may further comprise the step of providing a gas pressure in the second sealed-off space by means of the first gas conduct, the gas pressure being lower than the gas pressure of the refrigerant in the first sealed-off space by at least 3 bar, while the refrigerant is recovered, the absolute gas pressure in the second sealed-off space preferably being below 1 bar, such as below 0.5 bar, preferably below 0.1 bar.

Alternatively, the method may previous to the recovering of the refrigerant further comprise the step of providing a gas pressure in the second sealed-off space by means of the first gas conduct, the gas pressure in the second sealed-off space being lower than the gas pressure of the refrigerant in the heat transfer system by at least 3 bar, the absolute gas pressure in the second sealed-off space (13, 113) preferably being below 1 bar, such as below 0.5 bar, so as to leak test the second sealed-off space.

The leak test may comprise the step of monitoring the pressure of the gas in the second sealed-off space for a period of time, such as one minute, by means of a pressure sensor in fluid connection with the second sealed-off space.

In some embodiments, the method comprises, after the step of mounting the device and before the step of recovering of the refrigerant, the step of providing a gas pressure in the sealed-off space by means of the first gas conduit, the gas pressure in the sealed-off space exceeding the gas pressure of the refrigerant in the heat transfer system, such as by at least 0.5 bar, such as by at least 3 bar, so as to leak test the second sealed-off space.

In some embodiments, the method further comprises the steps of allowing a flow of the gas from the first internal gas opening and to the second internal gas opening and measuring the pressure of the gas that flows through the second gas conduit.

In some embodiments, the method comprises the step of providing a gas pressure in the sealed-off space by means of the first gas conduit, the gas pressure being lower than the gas pressure of the refrigerant in the heat transfer system by at least 3 bar, while the refrigerant is recovered, the absolute gas pressure in the sealed-off space preferably being below 1 bar, such as below 0.5 bar, preferably below 0.1 bar, so as to leak test the sealed-off space.

In some embodiments the leak test comprises the step of monitoring the pressure of the gas in the sealed-off space for a period of time, such as one minute, by means of a pressure sensor in fluid connection with the sealed-off space.

After the step of mounting the device and prior to the step of recovering of the refrigerant, the method may comprise monitoring the pressure of the sealed-off space so as to leak test. The leak test may be performed after the step of mounting the device and before forming the opening. The sealed-off space may be pressurized with air or nitrogen to a pressure equal to or higher than the refrigerant pressure in the heat transfer system. The pressure of the sealed-off space may be monitored for a period of time to verify when/if a pressure value is changing during the period of time. For example, if nitrogen is leaking into the heat transfer system the pressure of the sealed-off space will decrease.

After performing the leak test, the method may comprise the step of reducing the pressure in the sealed-off space or in the second sealed-off space. The method may further comprise the step of monitoring the pressure of the sealed-off space or the second sealed-off space during the provision of the opening and/or after the provision of the opening and during recovering of the refrigerant so as to second leak test. For example, if monitoring of the pressure indicates an increase in the pressure during the second leak test, this may be due to a leakage.

Moreover, in some embodiments, the method comprises monitoring the pressure of the gas in the first sealed-off space and/or in the second sealed-off space or in the sealed-off space and detecting the movement of the tool based on the monitored pressure. For example, the pressure within the sealed-off space or the first sealed-off space may increase after piercing the pipe and retracting the needle from the pipe. Specifically, detecting the movement of the needle and/or detecting the movement of the driver driving the movement of the tool may be based on changes in the monitored gas pressure. In some embodiments, the method comprises the step of monitoring the gas pressure and indicating that the step of providing the opening has occurred based on the monitored movement of the tool and/or the changes of related gas pressures.

BRIEF DESCRIPTION OF THE DRAWINGS

Embodiments of the present technology are illustrated with the enclosed figures of which.

The shown embodiments are provided for the purpose of illustrate the present technology and is not to be considered limiting the scope of protection.

DETAILED DESCRIPTION OF THE DRAWINGS

A device 1 according to a first embodiment is shown in FIGS. 1 to 5 for recovery of refrigerant of a heat transfer system by clamping a pipe 5 of the heat transfer system, creating an opening in the pipe 5 by means of piercing the wall of the pipe 5 with a needle and recover the refrigerant.

Figure 1:
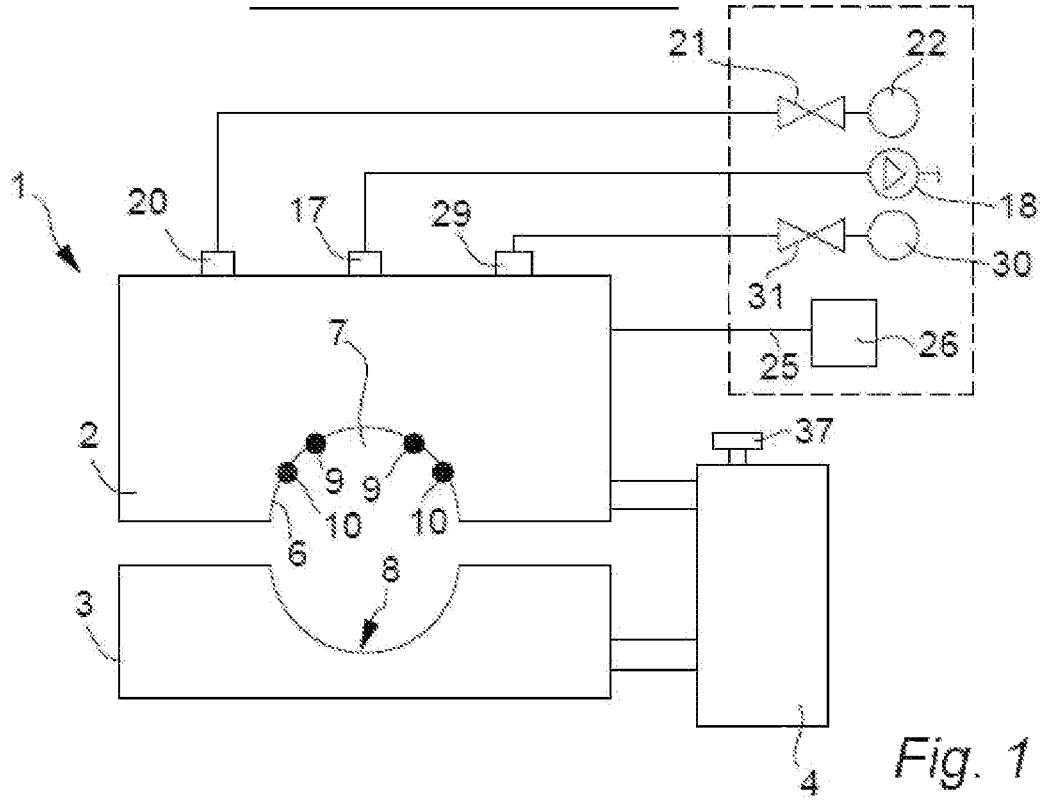
FIG. 1 is a side view of a device according to a first embodiment of the present technology in an open configuration.
Figure 2:
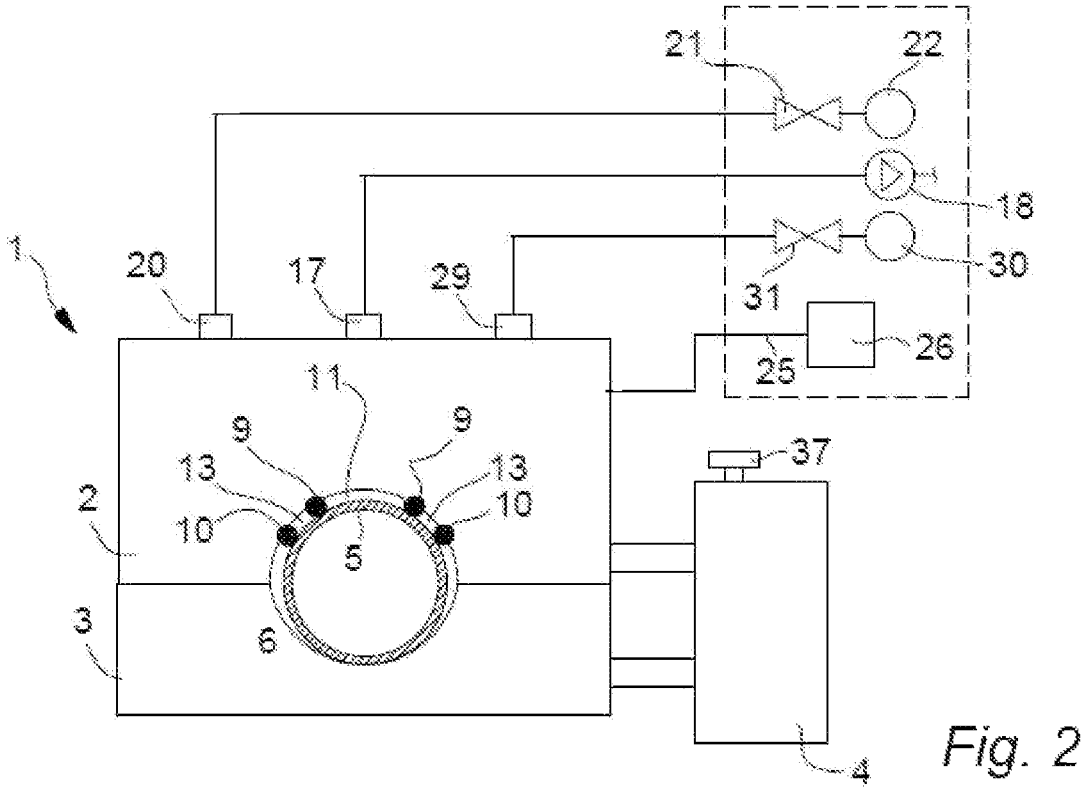
FIG. 2 is a side view of the device of FIG. 1 in a closed configuration, where it is clamped to a pipe of a heat transfer system.

The device 1 comprises an adaptor 2 and a jaw 3 for clamping around a pipe 5 by means of a handle 4 of the device 1, in which handle 4 can drive the adaptor 2 and the jaw 3 towards and away from each other in order to clamp the device 1 around the pipe 5 as shown in FIG. 2 and release the device 1 from the pipe 5, respectively.

Figure 3:
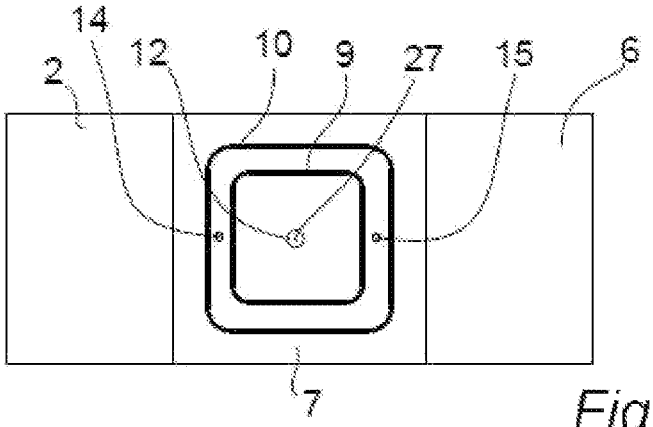
FIG. 3 is bottom view of the adaptor of the device of FIGS. 1 and 2.
Figure 4:
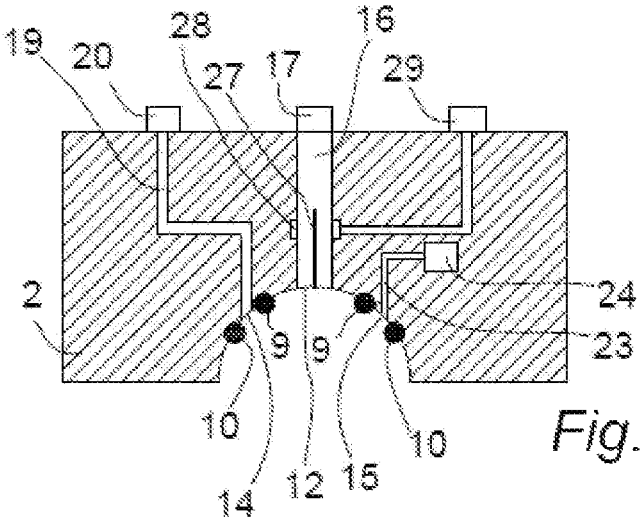
FIG. 4 is a cross-sectional side view of the adaptor of the device of FIGS. 1 and 2.

The adaptor 2 has in its bottom side surface 6 a semi-cylindrical recess 7 of a radius corresponding to the outer radius of the pipe 5 it is intended to be clamped to, and the jaw 3 has a corresponding recess 8. The recess 7 in the adaptor 2 is shown in FIG. 3 and comprises an inner, resilient gasket 9 and an outer, resilient gasket 10. The inner gasket 9 is suitable for providing a first sealed-off space 11 when the device 1 is clamped to the pipe 5, whereby a refrigerant inlet 12 formed in the bottom side surface 6 is included in the first sealed-off space 11. The first sealed-off space 11 is formed between the surface of the recess 7 in the adaptor 2, a surface of the clamped pipe 5 and the inner gasket 9.

The outer gasket 10 is suitable for providing a second sealed-off space 13 enclosing the first sealed-off space 11 so that the second sealed-off space 13 is formed between the surface of the recess 7 in the adaptor 2, a surface of the clamped pipe 5, the inner gasket 9 and the outer gasket 10 when the device 1 is clamped to the pipe 5. A first internal gas opening 14 and a second internal gas opening 15 are formed in the bottom side surface 6 and are included in the second sealed-off space 13.

The inner gasket 9 and the outer gasket 10 are O-ring seals seated in suitable grooves provided in the bottom surface 6 of the adaptor 2. In an alternative embodiment, the bottom surface 6, the inner gasket 9 and the outer gasket 10 are moulded as a single unit in a suitable, resilient material.

The refrigerant inlet 12 is connected by means of a refrigerant conduct 16 to a refrigerant outlet 17 of the adaptor 2. When the device 1 is in use, the refrigerant outlet 17 is connected to a ventilator 18 for evacuating the heat transfer system of refrigerant. The refrigerant may be led to environmental recipient, such as the atmosphere via a chimney, or be recovered.

The first internal gas opening 14 is connected by means of a first gas conduct 19 to a first external gas opening 20 of the adaptor 2. When the device 1 is in use, the first external gas opening 20 is connected by means of a valve 21 to a source 22 of pressurized gas, such a nitrogen. In an alternative use of the device 1, the external gas opening 20 is connected to a second ventilator (not shown) for providing a suction in the second sealed-off space 13.

The second internal gas opening 15 is connected by a second gas conduct 23 to a pressure sensor 24 in the adaptor 2, the pressure sensor 24 being connected 25 to a control unit 26.

There is a needle 27 provided in the refrigerant conduct 16 being displaceable out through the refrigerant inlet 12 by means of a pneumatic actuator 28 for puncturing a pipe 5 clamped between the adaptor 2 and the jaw 3. The pneumatic actuator is connected to a pneumatic port 29 of the adaptor 2, which with the device 1 in use is connected to a source 30 of pressurized air via a valve 31. The actuator 28 may e.g. in alternative embodiments be electric, electromagnetic or hydraulic.

The actuator 28 is arranged for advancing the needle 27 to pierce the outer wall of the part 5 of the pipe 5 thereby providing an opening in an opening area of the pipe 5.

Figure 7A:
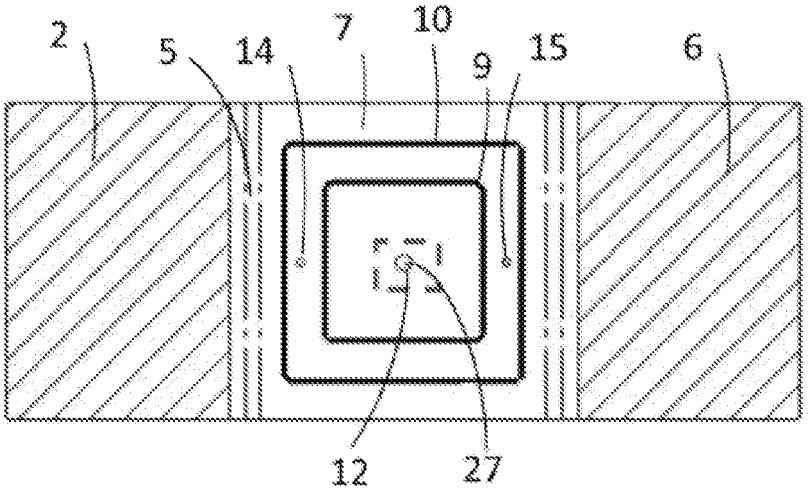
FIG. 7*a* is cross-sectional top view of the adaptor of the device of FIG. 2.
Figure 7B:
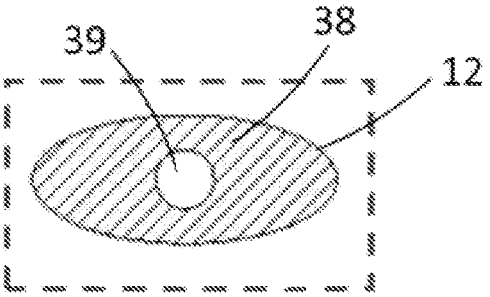
FIG. 7*b* is a top view of a refrigerant inlet of the device of FIG. 2.

FIG. 7*a* is an illustration of a cross-sectional top view of an adaptor 2 in accordance with some embodiments where the adaptor 2 is clamped to a pipe 5 of a heat transfer system. FIG. 7*b* is an illustration of a top view of the refrigerant inlet 12 of the adaptor shown in FIG. 7*a*. FIG. 7*b* shows an enlarged view of the dashed rectangular region indicated in FIG. 7*a*. The refrigerant inlet 12 is provided in a surface 6 of the device. A needle 27 is configured to form an opening 39 on an opening area 38 of the pipe 5. Specifically, the driver drives the needle 27 towards the opening area 38, such that the needle 27 punctures the pipe 5 and provides the opening 39. The needle 27 is then driven away from the pipe 5 such that the refrigerant can be recovered through the opening 39 between the refrigerant inlet 12 and the opening area 38 of the pipe 5.

The handle 4 is provided with a finger knob 37 for manually adjusting the distance between the adaptor 2 and the jaw 3 so as to clamp or release a pipe 5. Alternatively, the adjustment of the distance may be conducted automatically using a driver, such as a pneumatic or an electric driver.

Figure 5:
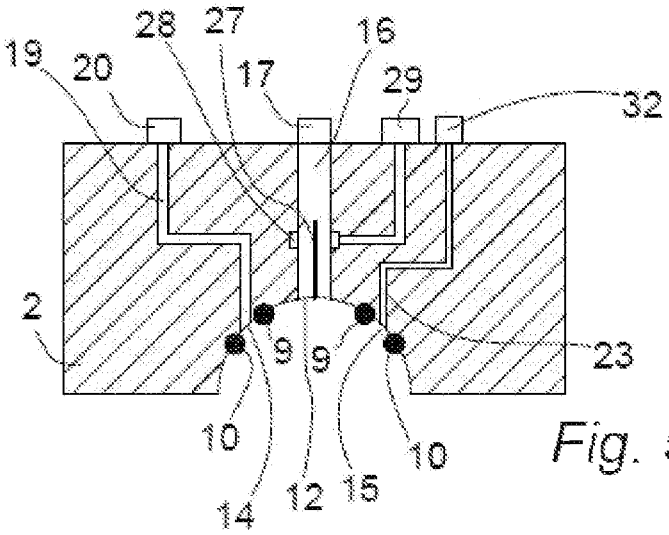
FIG. 5 is a cross-sectional side view of a variation of the adaptor of FIG. 4.

In a different embodiment of the adaptor 2 shown in FIG. 5, the pressure sensor 24 is omitted and the second gas conduct 23 extends from the second internal gas opening 15 to a second external gas opening 32, which in use of the device is connected to e.g. an external pressure sensor (not shown) and/or may allow for a flow of gas through the second sealed-off space 13 in order to test the inner gasket 9 and the outer gasket 10 before recovering the refrigerant. In some embodiments, the second gas conduct 23 extends from the second internal gas opening 15 to a second external gas opening 32, which in use of the device is connected to an external pressure sensor and may allow for a flow of gas through the sealed-off space 40 shown in FIG. 8 in order to test the outer gasket 10 before recovering the refrigerant.

The pressure sensor 24, internal or external, may be employed to surveillance of the pressure in the second sealed-off space 13 (or in the sealed-off space 40), whether the pressure is supposed to be higher than the pressure of the refrigerant in the heat transfer system or lower, such as a vacuum, in order to ensure that the pressure in the second sealed-off space 13 (or in the sealed-off space 40), during operation of the device does not deviate from the intended pressure, which is an indication of a leakage of the inner gasket 9 or the outer gasket 10. The output from the pressure sensor 24 may trick a halt of a process for recovery of the refrigerant or issue a signal that the device 1 is not operating reliable, the signal may be issued to an internal alarm in the device 1 or to an entity external to the device 1.

Figure 6:
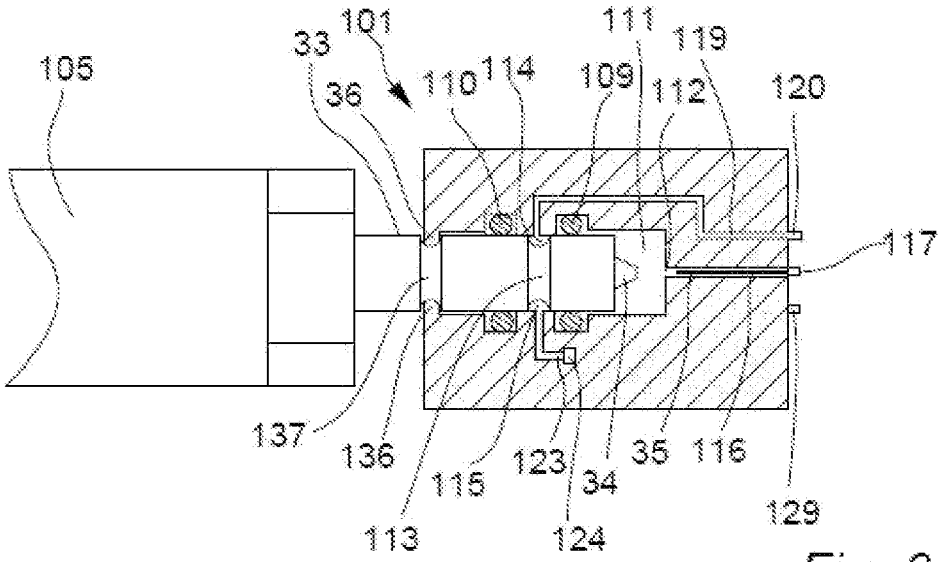
FIG. 6 is a longitudinal sectional view of a second embodiment of the present technology as mounted on a quick coupler.

A second embodiment of the present technology is shown in FIG. 6, which is a longitudinal section of a pipe 105 of a sealed heat transfer system, the pipe 105 being provided with a quick coupler 33, on which is clamped a device 101 according to a second embodiment of the present technology, which device is also shown in a longitudinal section.

The quick coupler 33 comprises a valve 34 which can be activated by means of a pin 35, which is moved into the valve 34 in the longitudinal direction of the pipe 105.

The device 101 of the second embodiment is provided with a mechanical lock 36 which is designed for interacting with a corresponding recess 37 of the quick coupler 33 when the device 101 is mounted on the quick coupler 33 to ensure that the two are fixed to each other.

The device 101 is provided with two O-ring seals forming an inner gasket 109 and an outer gasket 110, respectively, and between the two forming a second sealed-off space 113 together with the quick coupler 33. The first internal gas opening 114 and the second internal gas opening 115 are provided in a surface of the device 101 and are included in the second sealed-off space 113.

A refrigerant inlet 112 is provided in the device 101, opening into the first sealed-off space 111 when the device 101 is mounted to the quick coupler 33. Inside the refrigerant conduct 116, a movable pin 35 is provided, which is driven by a pneumatic actuator 128 to selectively open the valve 34 of the quick coupler 33.

In some embodiments, the device 101 is provided with an O-ring seal forming an outer gasket 110, for example similar to the device shown in FIG. 6 but without the inner gasket 109. The first internal gas opening 114 and the second internal gas opening 115 are provided in a surface of the device 101 and are included in a sealed-off space provided between the outer gasket 110 and a surface of the device 101 and a surface of the part of the heat transfer system. The sealed-off space therefore comprises the first sealed-off space 111 and the second sealed-off space 113 and is in fluid communication with the first internal gas opening 114 and the second internal gas opening 115.

Figure 8:
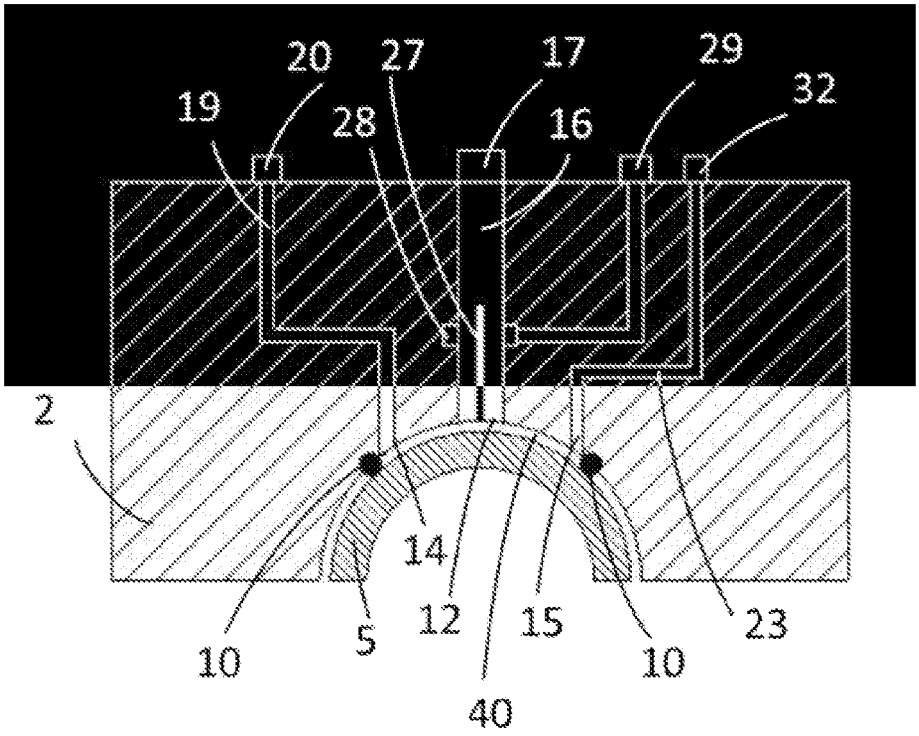
FIG. 8 is a cross sectional side view of an adaptor of a device in accordance with some embodiments.
Figure 9:
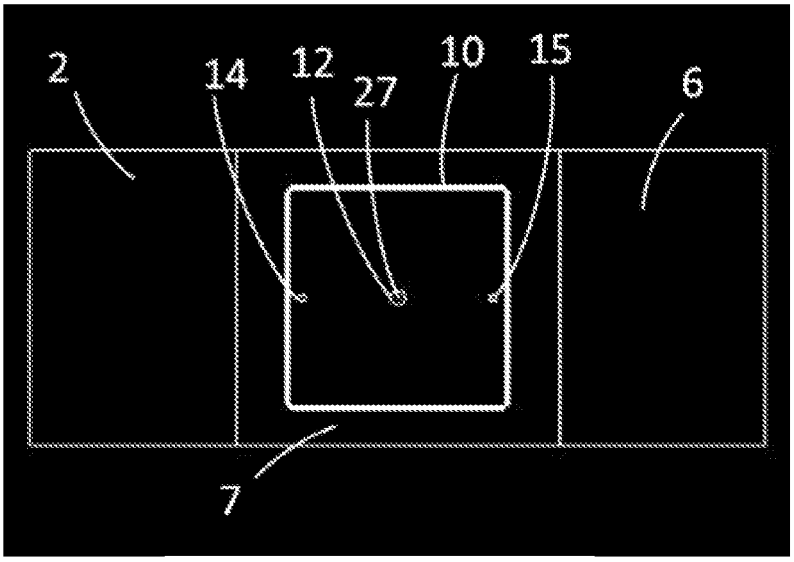
FIG. 9 is a bottom view of the adaptor of the device of FIG. 8.

FIG. 8 is a cross sectional side view of an adaptor of a device in accordance with some embodiments. FIG. 9 is a bottom view of the adaptor 2 of the device of FIG. 8. The device comprises a refrigerant conduit 16 formed in the device and guides a flow of refrigerant from the heat transfer system to a refrigerant outlet 17. The device further comprises a refrigerant inlet 12 to the refrigerant conduit 16. The refrigerant inlet 12 is on a surface 6 of the device. The device further comprises a tool 27 in the form of a needle, and a driver to drive a movement of the tool 27. A first gas conduit 19 of the device can guide flow of gas between a first internal gas opening 14 and a first external gas opening 20. A second gas conduit 23, a second internal and external gas openings 15, 32 are provided similar to the some of the embodiments described previously. In some embodiments, as shown in FIG. 8, the device comprises an outer gasket 10 arranged to provide a sealed-off space 40 enclosing a surface of the device, a surface of a pipe 5, the first internal gas opening 14, the second internal gas opening 15 when the device is mounted to the pipe 5.

LIST OF REFERENCE NUMERALS

1. Device for recovery of refrigerant
2. Adaptor
3. Jaw
4. Handle
5, 105. Pipe of heat transfer system
6. Bottom side surface of adaptor
7. Recess in adaptor
8. Recess in jaw
9, 109. Inner gasket
10, 110. Outer gasket
11, 111. First sealed-off space
12, 112. Refrigerant inlet
13, 113. Second sealed-off space
14, 114. First internal gas opening
15, 115. Second internal gas opening
16, 116. Refrigerant conduit
17, 117. Refrigerant outlet
18. Ventilator
19, 119. First gas conduit
20, 120. First external gas opening
21. Valve for external gas
22. Gas source
23, 123. Second gas conduit
24, 124. Pressure sensor
25. Connection for pressure sensor
26. Control unit
27. Needle
28, 128. Pneumatic actuator
29, 129. Pneumatic port
30. Source of pressurized air
31. Valve for pressurized air
32. Second external gas opening
33. Quick coupler
34. Valve of quick coupler
35. Pin
36. Mechanical lock
37. Finger knob
38. Opening area
39. Opening
40. Sealed-off space

What is claimed is:

1. A device for recovery of refrigerant from a sealed heat transfer system, the device comprising:

a refrigerant conduit formed in the device for guiding a flow of refrigerant from the heat transfer system to a refrigerant outlet of the device;

a refrigerant inlet to the refrigerant conduit, the refrigerant inlet being provided in a surface of the device;

a tool for providing an opening between an opening area of a part of the heat transfer system and the refrigerant inlet; and a driver to drive a movement of the tool in order to provide the opening in the opening area, wherein the device further comprises:

a first gas conduit formed in the device for guiding a flow of gas between a first internal gas opening being provided in a surface of the device and a first external gas opening of the device;

an outer, resilient gasket arranged to provide a sealed-off space enclosing a surface of the device, a surface of the part of the heat transfer system, the refrigerant inlet, and the first internal gas opening when the device is mounted to the part of the heat transfer system.

2. The device according to claim 1, further comprising:

a clamp for clamping the device to the part of the heat transfer system, wherein the clamp is employed to clamp the device to the part of the heat transfer system to mount the device to the part of the heat transfer system.

3. The device according to claim 1, wherein the tool is suitable for providing the opening in the opening area of the part of the heat transfer system by activating a valve of the heat transfer system.

4. The device according to claim 1, wherein the tool and the driver are arranged for providing the opening in the opening area of the part of the heat transfer system by forming an opening in an outer wall of the part of the heat transfer system.

5. The device according to claim 4, wherein the tool comprises:

a needle and the driver arranged for advancing the needle to pierce the outer wall of the part of the heat transfer system.

6. The device according to claim 1, further comprising:

a second gas conduit formed in the device between a second internal gas opening being provided in the device; and a pressure sensor, wherein the sealed-off space further comprises the second internal gas opening.

7. The device according to claim 1, further comprising:

a second gas conduit formed in the device for guiding a flow of gas between a second internal gas opening being provided in the device and a second external gas opening of the device, wherein the sealed-off space further includes the second internal gas opening, and wherein the sealed-off space forms a channel between the first internal gas opening and the second internal gas opening.

8. The device according to claim 7, wherein the second internal gas opening is included within a second sealed-off space, and wherein the second sealed-off space, forms a channel between the first internal gas opening and the second internal gas opening.

9. A method of recovering refrigerant from a sealed heat transfer system by use of the device according to claim 1, the method comprising:

mounting the device to a dedicated part of the heat transfer system;

providing an opening at an opening area of the part of the heat transfer system by the tool; and recovering of refrigerant from the sealed heat transfer system by allowing refrigerant to flow from the opening area through the sealed-off space, via the refrigerant inlet through the refrigerant conduit and the refrigerant outlet into a receiving arrangement for the refrigerant.

10. The method according to claim 9, which previous to the recovering of the refrigerant further comprises:

providing a gas pressure in a second sealed-off space by the first gas conduit, the gas pressure in the second sealed-off space being lower than the gas pressure of the refrigerant in the heat transfer system by at least 3 bar, the absolute gas pressure in a second sealed-off space being below 1 bar, so as to leak test the second sealed-off space.

11. The method according to claim 9, which after said mounting of the device and before said recovering of the refrigerant further comprises:

providing a gas pressure in the sealed-off space by the first gas conduit, the gas pressure in the sealed-off space exceeding the gas pressure of the refrigerant in the heat transfer system, so as to leak test a second sealed-off space, and/or wherein the device further comprises a second gas conduit formed in the device for guiding a flow of gas between a second internal gas opening being provided in the device and a second external gas opening of the device, and wherein said providing of the gas pressure in the sealed-off space to leak test the sealed-off space, further comprises:

allowing a flow of the gas from the first internal gas opening and to the second internal gas opening and measuring the pressure of the gas that flows through the second gas conduit.

12. The method according to claim 9, further comprising:

providing a gas pressure in the sealed-off space by the first gas conduit, the gas pressure being lower than the gas pressure of the refrigerant in the heat transfer system by at least 3 bar, while the refrigerant is recovered, the absolute gas pressure in the sealed-off space being below 1 bar, so as to leak test the sealed-off space.

13. The method according to claim 9, which previous to the recovering of the refrigerant further comprises:

providing a gas pressure in a second sealed-off space by the first gas conduit, the gas pressure in the second sealed-off space being lower than the gas pressure of the refrigerant in the heat transfer system by at least 3 bar, the absolute gas pressure in the second sealed-off space being below 0.5 bar, so as to leak test the second sealed-off space.

14. The method according to claim 9, which after said mounting of the device and before said recovering of the refrigerant further comprises:

providing a gas pressure in the sealed-off space by the first gas conduit, the gas pressure in the sealed-off space exceeding the gas pressure of the refrigerant in the heat transfer system by at least 3 bar, so as to leak test a second sealed-off space.

15. A device for recovery of refrigerant from a sealed heat transfer system, the device comprising:

a refrigerant conduit formed in the device for guiding a flow of refrigerant from the heat transfer system to a refrigerant outlet of the device;

a refrigerant inlet to the refrigerant conduit, the refrigerant inlet being provided in a surface of the device;

a tool for providing an opening between an opening area of a part of the heat transfer system and the refrigerant inlet; and a driver to drive a movement of the tool in order to provide the opening in the opening area, wherein the device further comprises:

a first gas conduit formed in the device for guiding a flow of gas between a first internal gas opening being provided in a surface of the device and a first external gas opening of the device;

an outer, resilient gasket arranged to provide a sealed-off space enclosing a surface of the device, a surface of the part of the heat transfer system, the refrigerant inlet, and the first internal gas opening when the device is mounted to the part of the heat transfer system;

an inner, resilient gasket arranged to provide a first sealed-off space including the opening area and the refrigerant inlet when the device is mounted to the part of the heat transfer system, and wherein the outer, resilient gasket is arranged to provide a second sealed-off space enclosing the first sealed-off space and including the inner, resilient gasket.

16. A method of recovering refrigerant from a sealed heat transfer system by use of the device according to claim 2, the method comprising:

mounting the device to a dedicated part of the heat transfer system;

providing an opening at an opening area of the part of the heat transfer system by the tool; and recovering of refrigerant from the sealed heat transfer system by allowing refrigerant to flow from the opening area through the sealed-off space, via the refrigerant inlet through the refrigerant conduit and the refrigerant outlet into a receiving arrangement for the refrigerant, wherein the recovering of refrigerant from the sealed heat transfer system is performed by allowing refrigerant to flow from the opening area through the first sealed-off space, and/or wherein the refrigerant is a flammable and/or toxic fluid.

17. The method of claim 16, comprising:

providing a gas pressure of a gas in the second sealed-off space by the first gas conduit, the gas pressure in the second sealed-off space exceeding the gas pressure of the refrigerant in the first sealed-off space, and/or wherein the gas is an oxygen-free gas.

18. The method according to claim 17, which after said mounting of the device and before said recovering of the refrigerant further comprises:

providing a gas pressure in the second sealed-off space by the first gas conduit, the gas pressure in the second sealed-off space exceeding the gas pressure of the refrigerant in the heat transfer system, so as to leak test the second sealed-off space.

19. The method according to claim 18, wherein the device further comprises a second gas conduit formed in the device for guiding a flow of gas between a second internal gas opening being provided in the device and a second external gas opening of the device, and wherein said providing of the gas pressure in the second sealed-off space to leak test the second sealed-off space, further comprises:

allowing a flow of the gas from the first internal gas opening and to the second internal gas opening; and measuring the pressure of the gas that flows through the second gas conduit.

20. The method according to claim 16, further comprising:

providing a gas pressure in a second sealed-off space by the first gas conduit, the gas pressure being lower than the gas pressure of the refrigerant in the first sealed-off space by at least 3 bar, while the refrigerant is recovered, the absolute gas pressure in the second sealed-off space being below 1 bar.

21. The method according to claim 16, comprising:

providing a gas pressure of a gas in a second sealed-off space by the first gas conduit, the gas pressure in the second sealed-off space exceeding the gas pressure of the refrigerant in the first sealed-off space by at least 3 bar, while the refrigerant is recovered.

22. The method according to claim 16, further comprising:

providing a gas pressure in a second sealed-off space by the first gas conduit, the gas pressure being lower than the gas pressure of the refrigerant in the first sealed-off space by at least 3 bar, while the refrigerant is recovered, the absolute gas pressure in the second sealed-off space being below 0.1 bar.

23. The method according to claim 17, which after said mounting of the device and before said recovering of the refrigerant further comprises:

providing a gas pressure in the second sealed-off space by the first gas conduit, the gas pressure in the second sealed-off space exceeding the gas pressure of the refrigerant in the heat transfer system by at least 3 bar, so as to leak test the second sealed-off space.

24. The method according to claim 18, wherein the leak test comprises:

monitoring the pressure of the gas in the second sealed-off space, or in the sealed-off space, for a period of time, by a pressure sensor in fluid connection with the second sealed-off space, or with the sealed-off space, respectively.

25. The device according to claim 15, further comprising:

a clamp for clamping the device to the part of the heat transfer system, wherein the clamp is employed to clamp the device to the part of the heat transfer system to mount the device to the part of the heat transfer system.

26. The device according to claim 15, wherein the tool is suitable for providing the opening in the opening area of the part of the heat transfer system by activating a valve of the heat transfer system.

27. The device according to claim 26, wherein the valve of the heat transfer system is a quick coupler valve.

28. The device according to claim 15, wherein the tool and the driver are arranged for providing the opening in the opening area of the part of the heat transfer system by forming an opening in an outer wall of the part of the heat transfer system.

29. The device according to claim 15, further comprising:

a second gas conduit formed in the device between a second internal gas opening being provided in the device; and a pressure sensor, wherein the sealed-off space further comprises the second internal gas opening.

30. The device according to claim 15, further comprising:

a second gas conduit formed in the device for guiding a flow of gas between a second internal gas opening being provided in the device and a second external gas opening of the device, wherein the sealed-off space further includes the second internal gas opening, and wherein the sealed-off space forms a channel between the first internal gas opening and the second internal gas opening.

* * * * *